US010471422B2

(12) United States Patent
Petrek et al.

(10) Patent No.: US 10,471,422 B2
(45) Date of Patent: Nov. 12, 2019

(54) HOME POSITION LOCATING MECHANISM FOR MANUAL PIPETTE AND MANUAL PIPETTE EQUIPPED WITH SAME

(71) Applicant: Mettler-Toledo Rainin, LLC, Oakland, CA (US)

(72) Inventors: James S. Petrek, Danville, CA (US); William D. Homberg, Moab, UT (US)

(73) Assignee: Mettler-Toledo Rainin, LLC, Oakland, CA (US)

( * ) Notice: Subject to any disclaimer, the term of this patent is extended or adjusted under 35 U.S.C. 154(b) by 333 days.

(21) Appl. No.: 15/639,004

(22) Filed: Jun. 30, 2017

(65) Prior Publication Data

US 2019/0001319 A1 Jan. 3, 2019

(51) Int. Cl.
*B01L 3/02* (2006.01)

(52) U.S. Cl.
CPC ..... *B01L 3/0224* (2013.01); *B01L 3/0275* (2013.01)

(58) Field of Classification Search
CPC ..... B01L 3/0224; B01L 3/0217; B01L 3/0275
USPC ..... 73/864.13, 864.16, 864.18; 422/501, 422/504, 505, 515, 516
See application file for complete search history.

(56) References Cited

U.S. PATENT DOCUMENTS

| | | | | |
|---|---|---|---|---|
| 4,041,764 | A | 8/1977 | Sabloewski et al. | |
| 5,364,596 | A | 11/1994 | Magnussen, Jr. et al. | |
| 5,696,330 | A | 12/1997 | Heinonen | |
| 5,700,959 | A | 12/1997 | Homberg | |
| 5,792,424 | A | 8/1998 | Homberg et al. | |
| 6,352,673 | B1 | 3/2002 | Rainin et al. | |
| 6,365,110 | B1 | 4/2002 | Rainin et al. | |
| 6,645,433 | B2 | 11/2003 | Homberg et al. | |
| 7,674,432 | B2 | 3/2010 | Wilmer | |
| 2005/0142038 | A1* | 6/2005 | Petrek | B01L 3/0224 422/516 |
| 2012/0213677 | A1* | 8/2012 | Petrek | B01L 3/022 422/525 |
| 2015/0004078 | A1 | 1/2015 | Baron | |

FOREIGN PATENT DOCUMENTS

WO 2013/120862 A1 8/2013

OTHER PUBLICATIONS

Mettler-Toledo Intl., Pipet-Lite LTS Pipette L-1000XLS+, accessed online on Mar. 8, 2019 at https://www.shoprainin.com/Products/Pipettes-and-Tips/Pipettes/Single-Channel-Manual-Pipettes/Pipet-Lite-XLS-LTS/Pipet-Lite-LTS-Pipette-L-1000XLS%2B/p/17014382, 2018, 3 pages.
Mettler-Toledo Rainin, LLC, Figure Pipet-XLS+, Jan. 2017, 1 page.

* cited by examiner

*Primary Examiner* — Robert R Raevis
(74) *Attorney, Agent, or Firm* — Standley Law Group LLP; Jeffrey J. Standley; Eric M. Gayan

(57) ABSTRACT

A pipette home position locating mechanism and a manual pipette equipped with such a home position locating mechanism. The home position locating mechanism is spring-biased but compressible in a proximal-to-distal direction. The spring preload force of the home position locating mechanism is selected to be greater than force of exerted by a stroke spring of the pipette to which the home position locating mechanism is attached while the stroke spring is at its blowout position, but less than the combined force exerted by the stroke spring at its blowout position and a blowout spring of the pipette in its preload position.

23 Claims, 15 Drawing Sheets

HOME POSITION LOCATING MECHANISM FOR MANUAL PIPETTE AND MANUAL PIPETTE EQUIPPED WITH SAME

TECHNICAL FIELD

Exemplary embodiments described herein are directed generally to a home position locating mechanism for a pipette and to a pipette that includes such a mechanism.

BACKGROUND

As would be understood by one of skill in the art, a pipette is a device that normally includes a removable pipette tip and is used to transfer or distribute a measured volume of liquid from one location to another. Manually-operated (manual) air-displacement pipettes, which are of the most interest with respect to this application, typically include an elongated hand-holdable pipette body housing an upwardly spring biased plunger unit. The plunger unit includes at least a piston and a plunger rod and is supported for axial movement in the pipette body between a first or upper stop position in which a proximal end portion of the plunger unit extends from a proximal (upper) end of the pipette body, and a second or lower stop position at which all liquid is expelled from the pipette tip. In operation, a pipette user grips the pipette body with a thumb placed over the exposed end (e.g., a plunger button) of the plunger unit. A depression of the plunger unit by the user moves the plunger unit distally (downward) from its upper stop position toward the lower stop position, against the upward bias of a stroke spring.

A plunger unit "home" position is located between the upper stop position and the lower stop position. In known manual pipettes, the home position is defined by a "soft" stop. Such a soft stop is typically created through the use of a second and relatively stiff spring located within the pipette body. This second spring is commonly referred to as a blowout spring, and typically assists in returning the plunger unit toward the upper stop position after a pipette blowout stroke. The blowout spring, as well as the other springs of a typical pipette, are normally compressed by a small amount during installation. As would be well understood by one of skill in the art, this compression imparts a preload to the springs, the associated force of which depends on the spring rate of the given spring and its distance of compression. The home position (soft stop) of the pipette is indicated when a shoulder or some other provided feature of the plunger unit contacts the blowout spring, which is only activated (further compressed) if the depression force exerted on the plunger button exceeds the preload force of the blowout spring.

In the case of a manual pipette with a home position (soft stop), the pipette user can "feel" via the thumb an increased resistance to movement of the plunger unit when the plunger unit reaches the home position. The felt increased resistance to movement is associated with the preload force of the blowout spring, which opposes further downward movement of the plunger unit. Thus, stated another way, the home position of the plunger unit is defined by the point at which the user first feels through the plunger button an increase in the force of resistance to plunger unit movement, without a corresponding further movement of the plunger unit. Continued movement of the plunger unit beyond the home position to the lower stop position defines the aforementioned blowout stroke, and is resisted by a combination of the stroke spring and the blowout spring.

To pipette a liquid using a known manual pipette, a user first depresses the plunger unit as described above, such that the plunger unit is moved away from the upper stop position against the force of the stroke spring. The user halts depression of the plunger unit when the user detects the home position as indicated by the feeling of increased resistance that results from the preload force of the blowout spring and is transmitted to the user's thumb. Once the home position is reached, the user submerges the opening of the pipette tip attached to the pipette in a liquid of interest, and subsequently releases the plunger unit, which is returned to the upper stop position by the stroke spring. The return stroke of the plunger unit and its associated piston creates a vacuum, and an amount of the liquid is consequently drawn into the pipette tip in response.

Because the distance of piston movement from the home position to the upper stop position defines the volume of liquid that will be aspirated into the pipette tip during the aspiration phase of the pipetting operation, it should be understood that pipetting accuracy in the case of known manual pipettes depends greatly on the ability of a user to return the plunger unit to the same home position at the beginning of each pipetting operation. If the user stops the plunger unit short of the home position, a less than intended amount of liquid will be aspirated. If the user drives the plunger unit past the home position, a more than intended amount of liquid will be aspirated. Consequently, an accurate sensing of the home position is critical to obtaining accurate and repeatable pipetting results.

Depressing the plunger unit of a known manual pipette and stopping at the home position is a delicate operation requiring that great care be exercised by the pipette user if accurate and repeatable results are to be obtained. In fact, it has been found that a significant portion of the total time associated with a pipetting operation is occupied by the pipette user manually maintaining the plunger unit at the sensed home position and ready for insertion of the pipette tip into the liquid which is to be aspirated by the pipette.

In practice, it has also been found that most pipette users have great difficulty in consistently stopping the plunger unit of known manual pipettes in the same home position over repeated pipetting operations, and also in maintaining said position until the plunger unit is released to aspirate a liquid. In this regard, one exemplary and fairly common pattern of actual plunger unit depression force and plunger unit travel during operation of a typical and known manual pipette is represented in the depression force versus plunger unit position graph of FIG. 1A. As shown in FIG. 1A, a user initially exerts an actuating force on the plunger unit that causes the plunger unit to move from the upper stop position at point B to the home position at point C (as detected by the user). As explained above, the home position is the position at which the blowout spring is contacted by a shoulder or other feature of the plunger unit and begins to offer an increased resistance to further plunger movement. The home position of the plunger unit is represented in the graph of FIG. 1A by the line extending between point C and point D, which also indicates the increased depression force required to further move the plunger unit at point D as the blowout spring is engaged and begins to compress. The line extending between point D and point E in FIG. 1A represents further movement of the plunger unit from the home position toward the lower stop position during a blowout stroke.

In an ideal depression force versus plunger position graph, the home position of the plunger unit would be represented by a single point (point C in FIG. 1A). In this case, the line between point C and point D would be perfectly vertical, indicating that there is no deviation of the plunger from the home position until a user deliberately depresses the plunger unit with sufficient additional force to begin compression of the blowout spring and the actual blowout stroke (at point D).

In reality, however, the home position as determined by a user over repeated pipetting operations is virtually never a single position. Rather, as illustrated in the enlarged view of FIG. 1B, the home position indicated by the line extending between point C and point D is actually sloped to the right—signifying that an undesired and unintended movement of the plunger unit is possible within the range of actuation force that a user may interpret as being indicative of the home position. This plunger unit movement around the home position is possible because of possible minor misalignment between pipette components, and/or because the home position is indicated by a "soft" stop provided through spring force, and the nature of springs is such that there is a narrow range of depression force that may be exerted between the point of encountering resistance to movement resulting from contact with the blowout spring, and actual compression of the blowout spring (as represented by the line between point C and point D). As a result, a user may exert different amounts of depression force within said range of depression force while still sensing the "home" position, and these different amounts of depression force will result in different positions of the plunger unit and in different aspiration volumes. In this particular example, it can be observed in FIG. 1B that the range of depression force within which a given user may detect the home position is between about 0.75 lbf. and about 2.4 lbf.

While the amount of plunger unit movement per increased magnitude of depression force may be small within the 0.75-2.4 lbf. range, this plunger movement may be nonetheless highly detrimental to producing accurate and repeatable pipetting results. As one example, consider an inexperienced user who is only able to repeat the depression force applied to the plunger unit of the pipette represented in FIGS. 1A-1B within a one pound range (e.g., between 1-2 lbf.). In such a case, it can be observed in FIG. 1B that the home position of the plunger unit will vary by approximately 0.003 inches (i.e., between 0.628 and 0.631 inches). If, for example, the pipette has a 0.620 inch stroke and is set to 100% volume, this 0.003 inch variation in home position represents only a 0.48% variation in aspiration volume. However, if the same pipette is set to a 10% volume setting, the 0.003 inch variation in home position represents a much more significant 4.8% variation in aspiration volume. Therefore, it can be understood how user sensitivity and skill have been paramount to achieving good pipetting results with known manual pipettes.

The above-identified problem may be further exacerbated if the pipette user has what is commonly referred to in the industry as a light or heavy thumb—generally indicating that the user does not have the preferred sensitivity to movement of the pipette plunger unit. Broadly speaking, a user with a light thumb will "feel" the home position at a lower plunger depression force than is actually required to reach the true home position, while a user with a heavy thumb will "feel" the home position at a plunger depression force that is actually greater than the force required to reach the true home position. This results in the two users pipetting different volumes of liquid, neither of which will match the calibrated volume. A user with a light thumb will, on average, pipette less liquid than a user with a heavy thumb.

In addition to the aforementioned problems surrounding plunger movement at the home position, accurate pipetting results also depend on the pipette user matching the same plunger depression force used during calibration of the pipette. Consequently, the ability to repeatably return the plunger unit to as close as possible to the same home position is even more important.

Based on the foregoing description, it should be obvious that there is a need for a manual pipette with which a user is able to more accurately and repeatably detect plunger unit home position within a narrower positional range. Exemplary home position locating mechanism and pipette embodiments described herein satisfy this need.

SUMMARY

Exemplary embodiments described herein are directed to a home position locating mechanism for a manual pipette, and to a manual pipette having a plunger unit equipped with such a home position locating mechanism so as to provide a user with the ability to more accurately and repeatably find the pipette home position. An exemplary pipette is a manual air-displacement pipette, and may include an elongated hand-holdable pipette body housing a plunger unit that is supported for axial movement in the pipette body between an upper stop position and a lower stop position, in a similar manner to that described above. A lower portion of the pipette body may be adapted for receiving and retaining a pipette tip.

A preloaded stroke spring is located within the pipette body to bias the plunger unit toward the proximal (upper) end of the pipette body. A plunger unit home position is again located between the upper stop position and the lower stop position, and is defined by a soft stop indicated by an increased resistance to further downward plunger movement provided by a blowout spring having a higher preload force than the stroke spring. In addition to its use in indicating proper home position, the blowout spring also assists in returning the plunger unit from a blowout stroke of the pipette.

An exemplary pipette also includes a home position locating mechanism. In one exemplary embodiment, the home position locating mechanism is built into a specialized plunger button that is affixed to a proximal end of a plunger rod component of the plunger unit. In another exemplary embodiment, the home position locating mechanism is located in the pipette body, such as at the proximal end thereof. In either case, the home position locating mechanism includes a compliance spring, and is designed and constructed so as to be repeatably compressible at the same depression force and within some range of movement when the force of the compliance spring is overcome during user movement of the plunger unit. The home position locating mechanism is preferably, but not essentially, intended to operate in the linear range of the home position force curve of the pipette to which the home position locating mechanism is installed. That is, the compliance spring of the home position locating mechanism is preferably, but not essentially, designed to overcome its preload and to begin compressing at a force that is in the linear portion of the home position force curve. In this regard, the provided spring of the home position locating mechanism has a higher preload force than the force exerted by the stroke spring in its blowout position, but a lower preload force than the combined force exerted by the stroke spring in its blowout position and the blowout spring in its preload position. Consequently, the home position locating mechanism will not begin to compress until the stroke spring is compressed and the plunger unit is in abutting contact with (a blowout spring-engaging flange or similar feature) and resisting the preload of the blowout spring—which is the point at which the plunger unit is in the proper home position.

An increase in depression force on the plunger button by the user at this point, will cause the compliance spring of the home position locating mechanism to overcome its preload, thereby permitting the home position locating mechanism to begin compressing. The home position locating mechanism is preferably able to compress a considerable distance in comparison to the resulting movement of the plunger unit.

The home position locating mechanism allows a user to accurately and repeatably find the pipette home position based on the compressive movement of the home position locating mechanism rather than by developing a "feel" of the depression force associated with the proper home position as indicated by the soft stop in known manual pipettes. This improves pipetting results, as a user need only realize (e.g., see, feel, hear) that the home position locating mechanism is somewhere within its range of compression to accurately and repeatably find the plunger unit home position. As long as the user maintains the plunger unit at a position where the home position locating mechanism is within said range of compression during each aspiration stroke, the plunger unit can be accurately and repeatably returned to within a very small positional variation of the same home position.

Other aspects and features of the general inventive concept will become apparent to those skilled in the art upon review of the following detailed description of exemplary embodiments along with the accompanying drawing figures.

BRIEF DESCRIPTION OF THE DRAWINGS

In the following descriptions of the drawings and exemplary embodiments, like reference numerals across the several views refer to identical or equivalent features, and.

DETAILED DESCRIPTION OF THE EXEMPLARY EMBODIMENTS

Figure 1A:
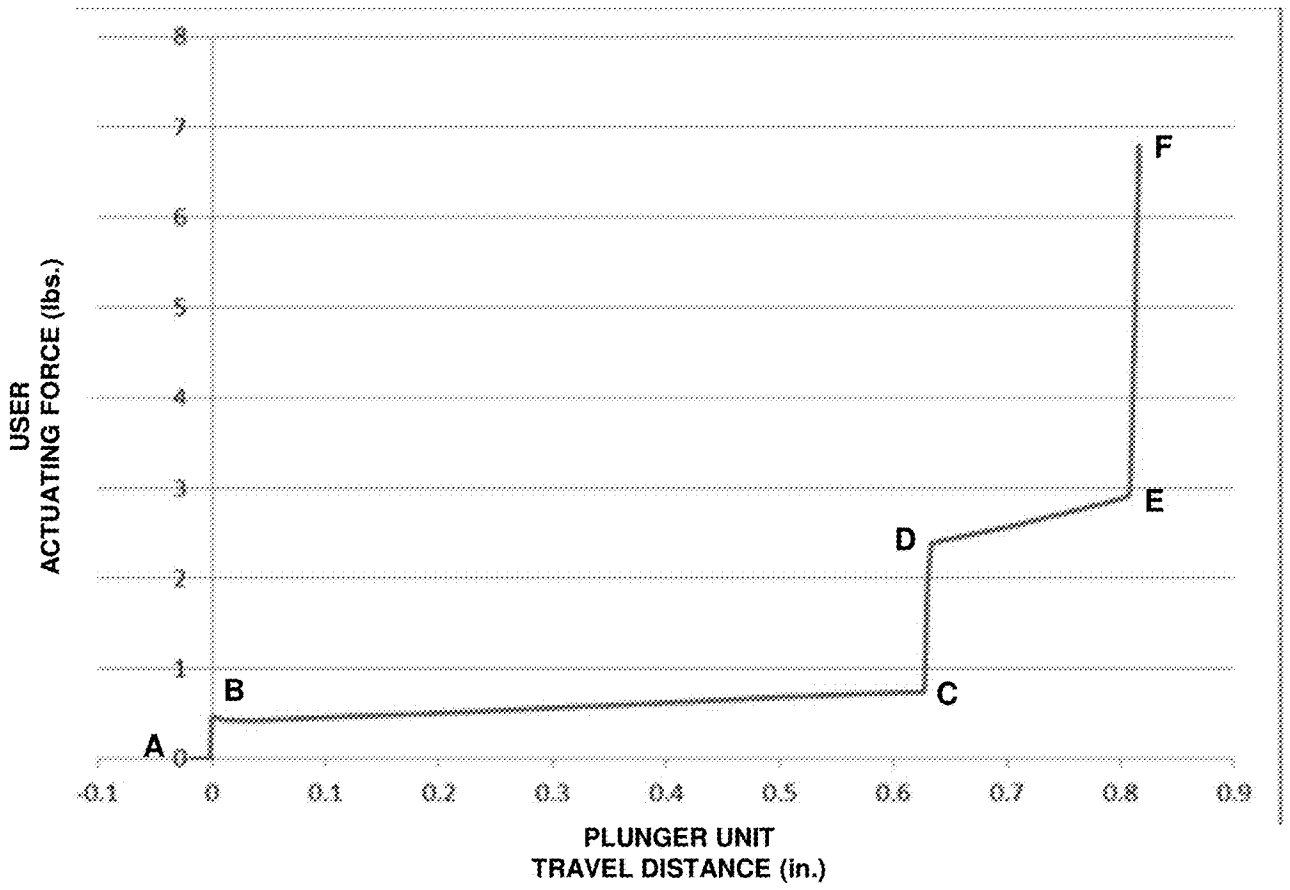
FIG. 1A is a graph showing user actuation force versus plunger unit travel for a typical known manual pipette.
Figure 1B:
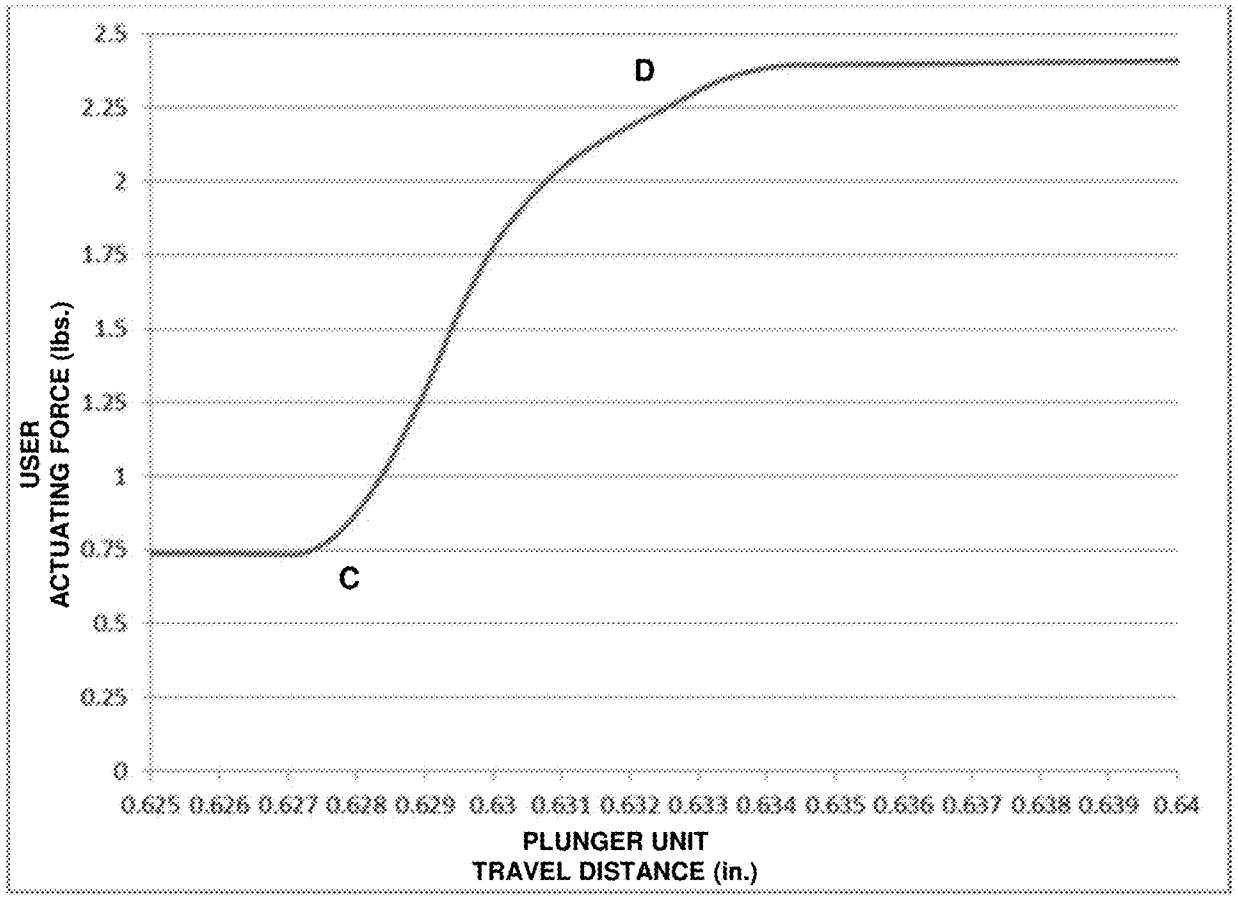
FIG. 1B is an enlarged view of a portion of the graph of FIG. 1A.
Figure 2A:
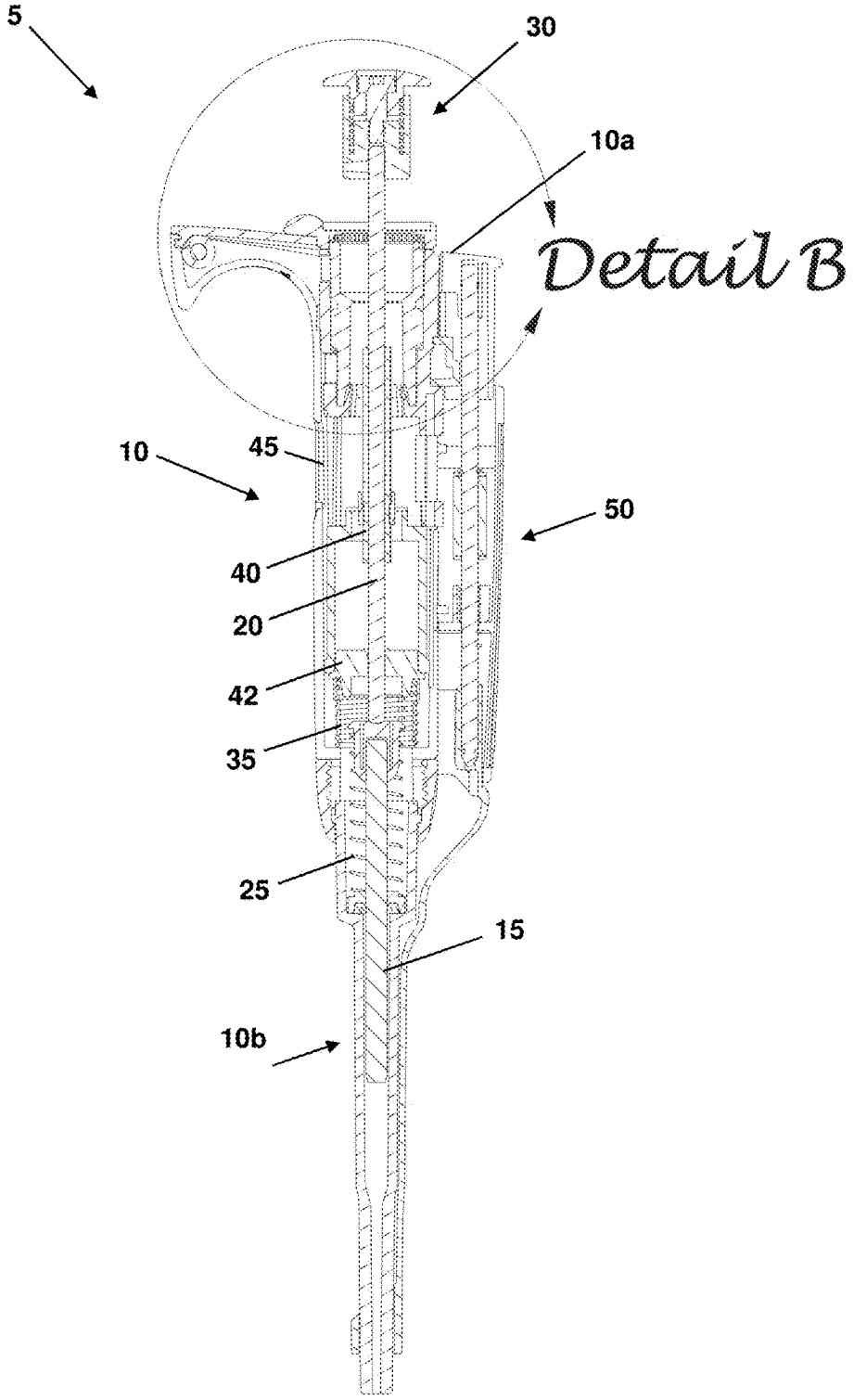
FIG. 2A shows an exemplary pipette equipped with an exemplary home position locating mechanism in the form of a compliant plunger button, and with a plunger unit thereof in an upper stop position.

One exemplary embodiment of a compliant plunger button-equipped, manually-operated air-displacement pipette 5 (hereinafter "compliant pipette" or just "pipette" for the sake of brevity) is depicted in FIG. 2A. As shown the pipette 5 includes a pipette body 10 with a distal tip mounting portion 10*b*, a plunger unit including a piston 15 and a plunger rod 20, and an exemplary compliant plunger button 30 that is affixed to a proximal end of the plunger rod. In the position shown in FIG. 2A, the compliant plunger button 30 is affixed to a portion of the plunger rod 20 that extends from a proximal end 10*a* of the pipette body 10. A stroke spring 25 and a blowout spring 35 are also located within the pipette. The plunger rod 20 includes a flange-engaging feature 40 (e.g., a sleeve) that interacts with a flange component 42 that is associated with and preloads the blowout spring 35. The blowout spring 35 and the flange 42 form a soft stop, and the flange-engaging feature 40 and the flange 42 cooperate to compress the blowout spring during a blowout stroke of the pipette.

The exemplary pipette 5 may be volume adjustable, and may also include other components such as, without limitation, a volume setting indicator 45 and a tip ejector 50. Generally speaking, user displacement of the piston 15 by way of the compliant plunger button 30 and associated plunger rod 20, and a cooperating reverse displacement of the piston by the stroke spring 25, is used to aspirate and dispense a liquid of interest.

Figure 2B:
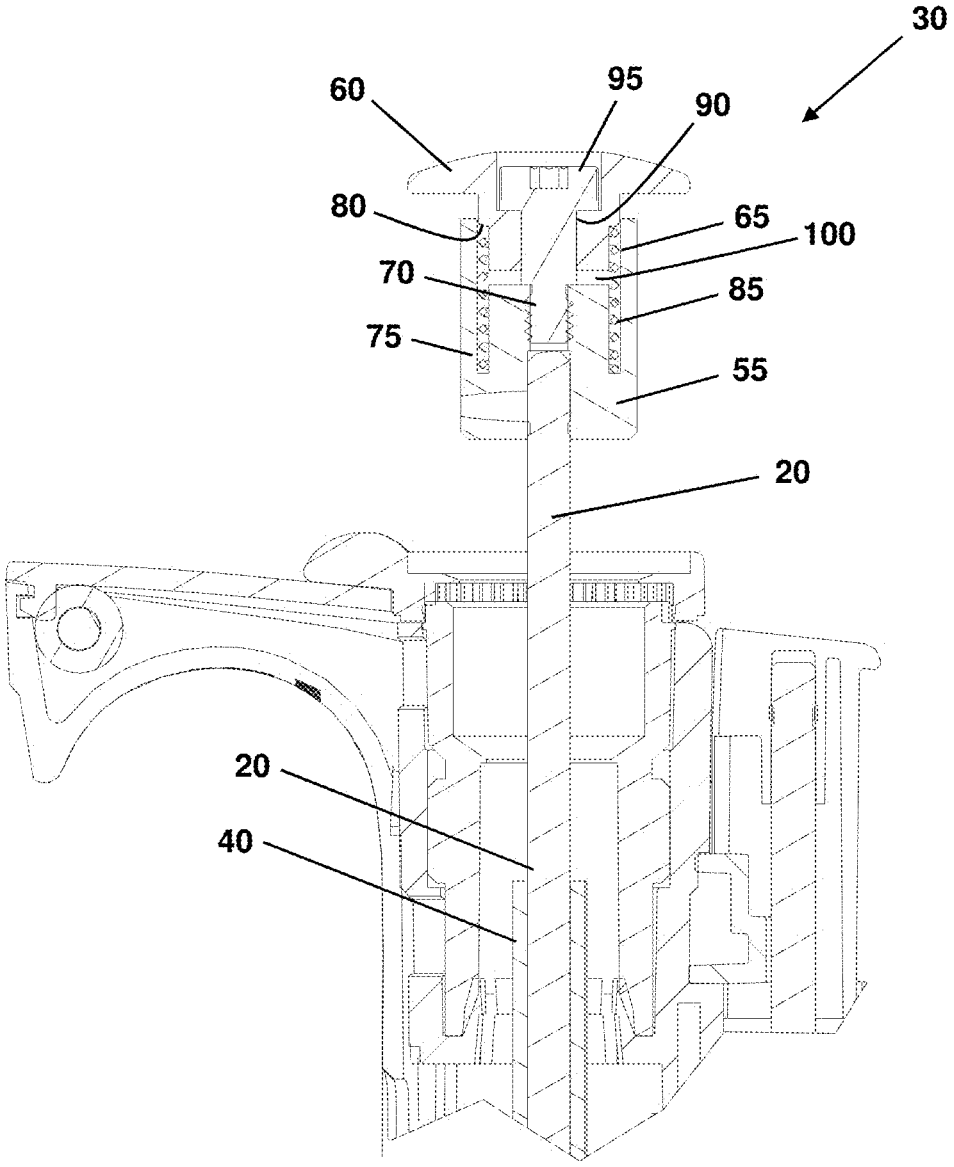
FIG. 2B is an enlarged detail view of compliant plunger button of FIG. 2A and its relationship to the pipette body.

An enlarged detailed view of the exemplary compliant plunger button 30 is presented in FIG. 2B. As shown, this exemplary compliant plunger button 30 is comprised of a lower component 55 and an upper component 60. The distal end of the lower component 55 of the compliant plunger button 30 receives the proximal end of the plunger rod 20 and is affixed thereto, such as with a set screw, adhesive, a press fit to a shoulder, etc. A proximal end of the upper component 60 of the compliant plunger button will normally be engaged by the thumb of a user during a pipetting operation.

The lower component 55 of this exemplary compliant plunger button 30 includes a counterbore 65 at its proximal end that is shaped and dimensioned to receive a distal end of the upper component 60 in a slip fit arrangement. The lower component 55 of the compliant plunger button 30 also includes a threaded central aperture 70 in the base of the counterbore. A concentrically located compliance spring retention groove 75 also resides in the lower portion 55 of the compliant plunger button 30, between the threaded central aperture 70 and the exterior wall.

The upper component 60 of the compliant plunger button 30 is of a stepped design. A lower step forms a compliance spring retention shoulder 80 that cooperates with a proximal portion of the lower component 55 and the compliance spring retention groove 75 located therein, to retain a compliance spring 85 within the assembled compliant plunger button 30. The upper component 60 of the compliant plunger button 30 further includes a stepped central aperture 90 through which is passed a shoulder bolt 95 or a similar retention element when the compliant plunger button is assembled.

When the compliant plunger button 30 is assembled, a distal portion of the compliance spring 85 is located in the compliance spring retention groove 75 of the lower component 55 and extends upward therefrom and beyond the base of the counterbore 65. The distal end of the upper component 60 is inserted in a slip fit arrangement into the counterbore, where the spring retention shoulder 80 engages a proximal end of the compliance spring 85. The shoulder bolt 95 is placed through the central aperture 90 of the upper component 60, and the threaded end thereof is threaded into the correspondingly threaded central aperture 70 of the lower component 55 to secure the upper component 60 to the lower component 55. The upper component 60 is positioned in the lower component 55 such that the spring retention shoulder 80 remains in the counterbore 65 when the assembled compliant plunger button 30 is in a fully uncompressed condition, thereby ensuring retention of the compliance spring 85.

The upper component 60 of the compliant plunger button 30 is assembled to the lower component 55 in a retained but axially displaceable arrangement. Particularly, a section of the stepped central aperture 90 in the upper component 60 rides on a non-threaded portion of the shoulder bolt shaft, thereby allowing for axial displacement of the upper component 60 relative to the shoulder bolt 95 and the lower component 55. The compliance spring 85 upwardly biases the upper component 60 when the compliant plunger button 30 is not being depressed by a user, thereby maintaining a gap 100 between the distal end of the upper component and the base of the counterbore 65 in the lower component 55. The gap 100 defines the compressive travel range of the compliant plunger button 30. The compliance spring 85 also offers a tactile resistance to compression of the compliant plunger button 30 during a pipetting operation, which aids the user in finding and maintaining the home position of the pipette piston 15.

The exemplary compliant plunger button 30 shown and described herein is provided only for purposes of illustration, and not limitation. It should be realized by one of skill in the art—particularly upon further reading of the application—that other compliant plunger button designs may also be employed as long as said designs allow for proper movement of the pipette plunger unit and for proper compression of the plunger button at an appropriate time.

Figure 3:
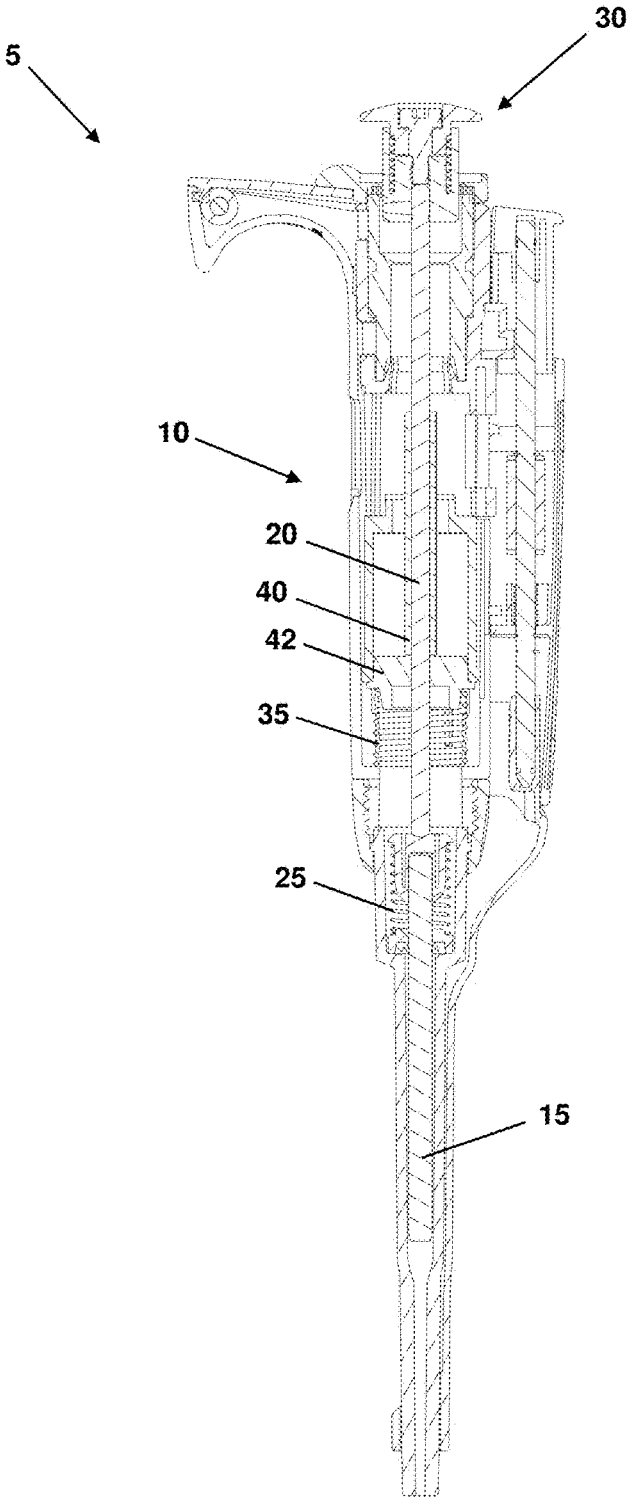
FIG. 3 shows the exemplary pipette of FIG. 2 with the plunger unit at the home position and the compliant plunger button thereof uncompressed.

The pipette 5 of FIGS. 2A-2B is depicted again in FIG. 3 with the plunger unit placed in the home position. In this position, it may be observed that the piston 15, the plunger rod 20 and the compliant plunger button 30 have all moved toward the distal end of the pipette 5, the stroke spring 25 has been compressed, and the flange-engaging feature 40 of the plunger rod is in contact with the flange 42 associated with the blowout spring 35. Upon initially reaching the home position, the compliant plunger button 30 has not yet begun to compress.

Figure 4A:
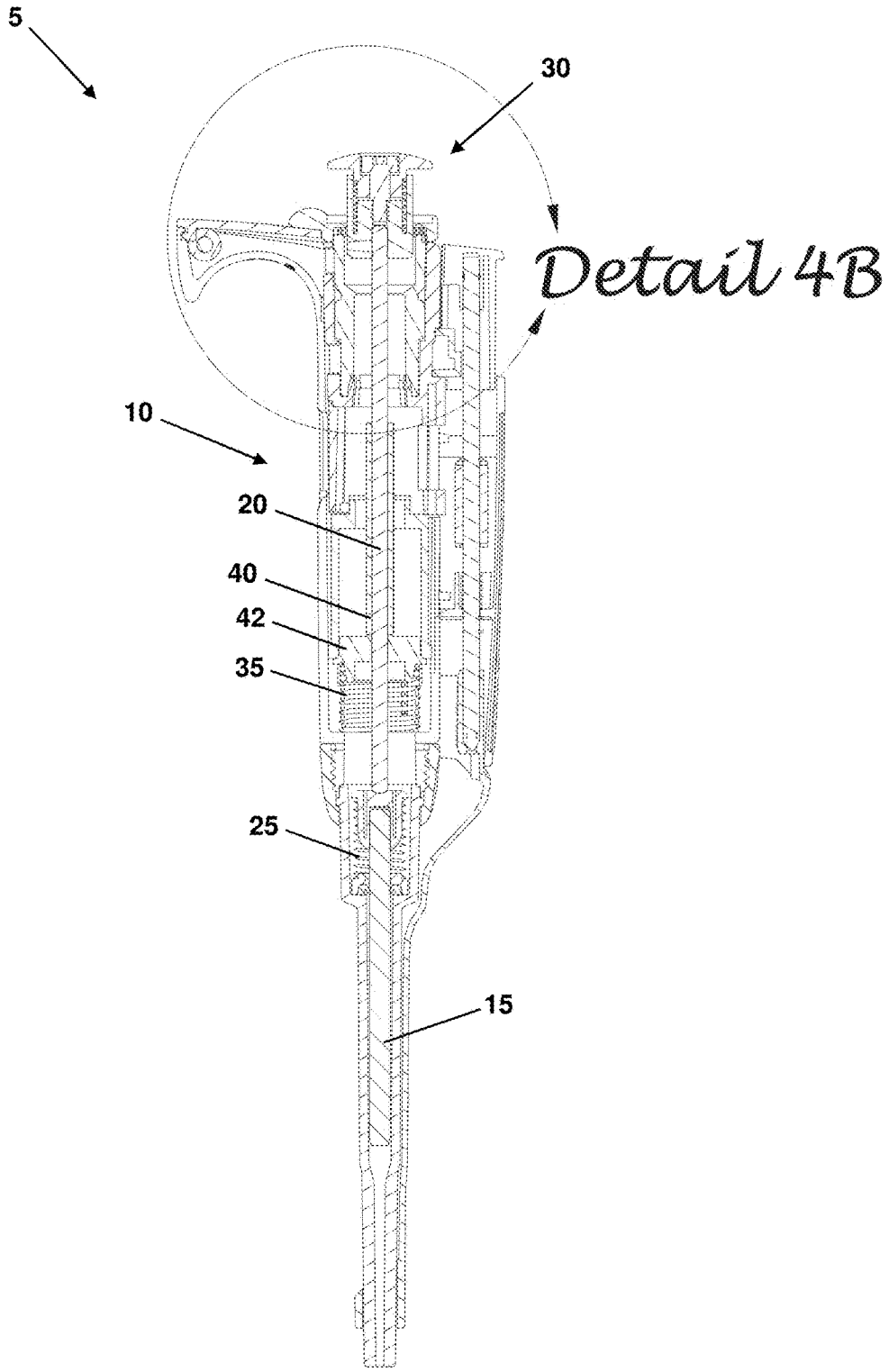
FIG. 4A shows the exemplary pipette of FIG. 2 with the plunger unit at the home position and the compliant plunger button thereof beginning to compress.
Figure 4B:
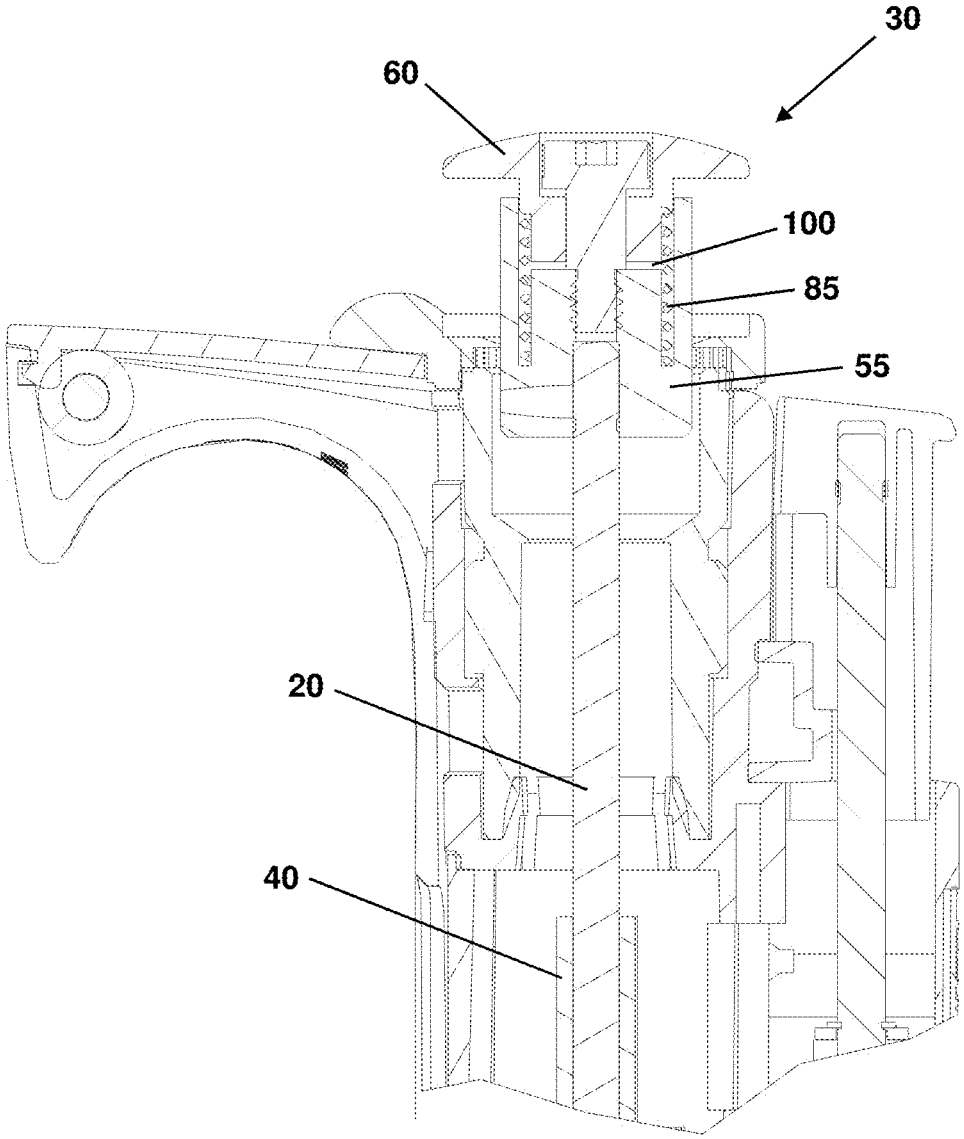
FIG. 4B is an enlarged detail view of the compliant plunger button of FIG. 4A.

A better understanding of the operation of the exemplary compliant plunger button 30 may be gained by reference to FIGS. 4A-4B. The pipette 5 of FIG. 3 is depicted again in FIG. 4A with the piston 15 still in the home position. However, at this point, the exertion of a further user-provided depression force on the compliant plunger button 30 has initiated compression thereof. Note that compression of the compliant plunger button 30 begins without the piston 15 or plunger rod 20 moving by any substantial degree toward the distal end of the pipette 5 relative to the position of said components in FIG. 3. Likewise, the stroke spring 25 remains in the compressed state (blowout position) of FIG. 3 and the blowout spring 35 has not yet been compressed beyond its preload position by movement of the flange-engaging feature 40 of the plunger rod 20.

To ensure that compliant plunger button compression will occur at the the home position, the compliance spring 85 of the compliant plunger button is provided with a higher preload force than the force exerted by the stroke spring 25 in its blowout position, but a lower preload force than the combined force exerted by the stroke spring in its blowout position and the blowout spring 35 in its preload position. As such, the compliance spring 85 will not overcome its installed preload and begin to compress until the stroke spring 25 is compressed and the flange-engaging feature 40 of the plunger unit is in abutting contact with the flange 42 and resisting the installed preload of the blowout spring 35—i.e., until the piston 15 is in the home position. Likewise, the blowout spring 35 will not be further compressed beyond its preload position until the compliant plunger button 30 is fully compressed, whereupon a further depression of the compressed compliant plunger button 30 will be transmitted to the blowout spring. This allows for a range of detectable compliant plunger button compression within which the piston 15 of the pipette 5 will remain substantially at the home position.

Initial compression of the compliant plunger button 30 may be better observed in FIG. 4B. As shown, the upper portion 60 of the compliant plunger button 30 has moved distally toward the lower component 55, thereby reducing the gap 100 between said components and also compressing the compliance spring 85.

Figure 5A:
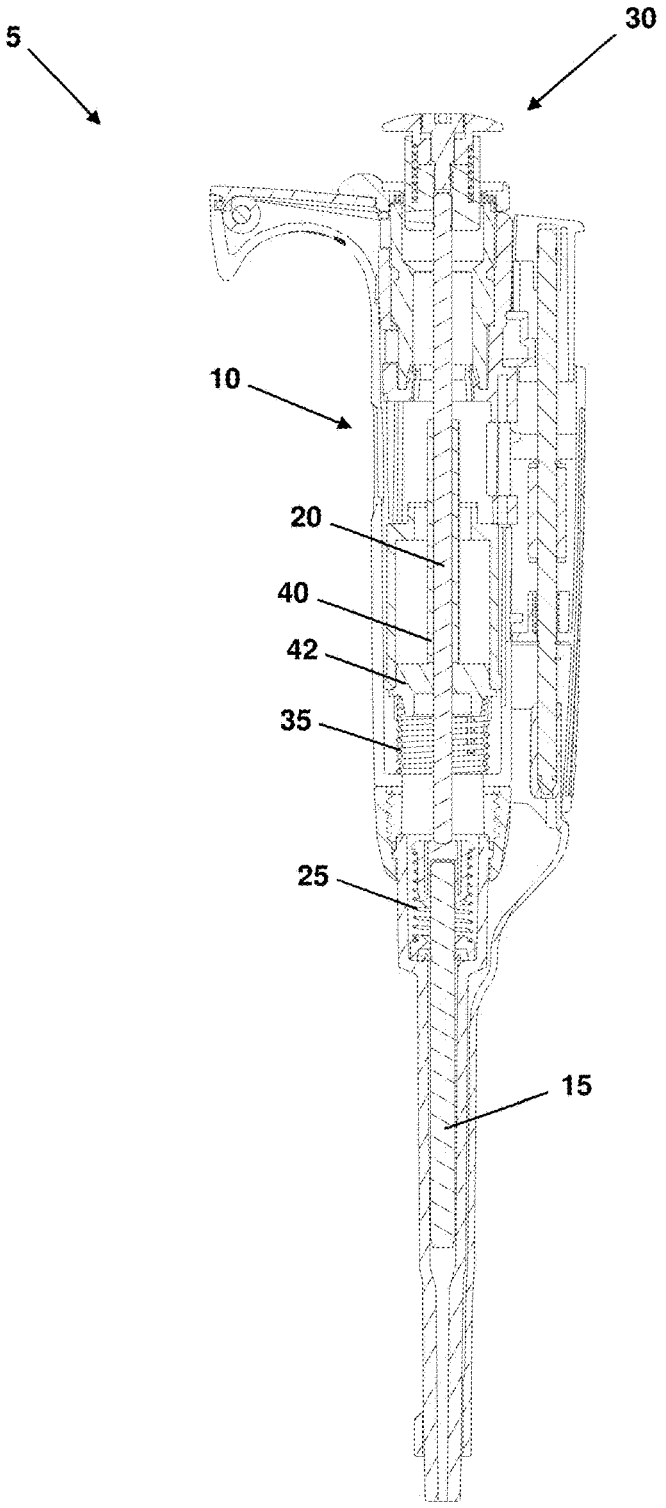
FIG. 5A shows the exemplary pipette of FIG. 2A with the plunger unit at the home position and the compliant plunger button thereof fully compressed.
Figure 5B:
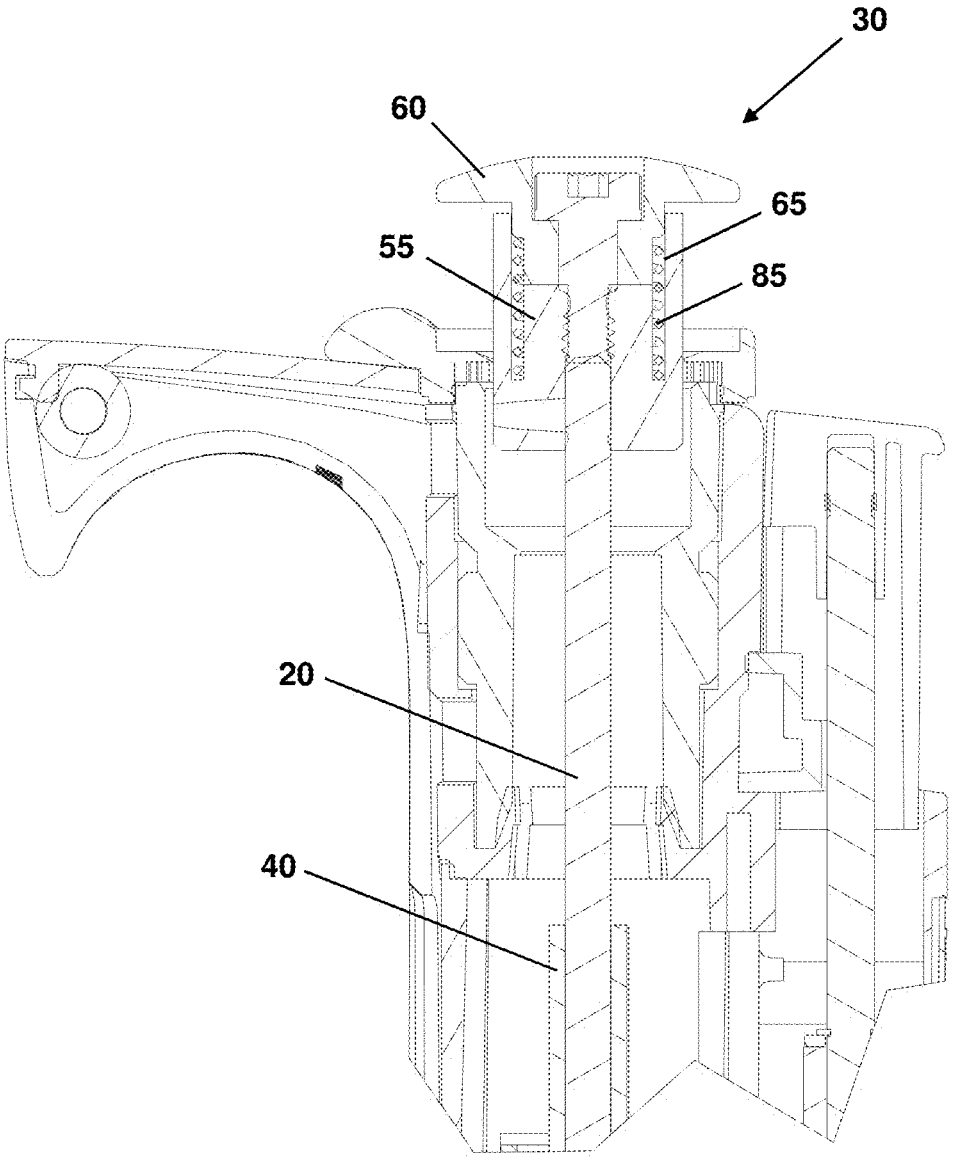
FIG. 5B is an enlarged detail view of the compliant plunger button of FIG. 5A.

The pipette 5 is shown in FIGS. 5A-5B with the compliant plunger button 30 in a fully compressed position. Note that full compression of the compliant plunger button 30 does not result in any substantial axial movement of the piston 15, the plunger rod 20, or the compliant plunger button 30 itself, and that the blowout spring 35 remains in its preload position. As better observed in FIG. 5B, however, the upper portion 60 of the compliant plunger button 30 has moved further toward the lower component 55, thereby fully closing the previously present gap 100 between said components and also further compressing the compliance spring 85. Thus, in this exemplary compliant plunger button 30, the base of the counterbore 65 in the lower component 55 acts as a hard stop for the distal end of the upper component 60—meaning that the compliant plunger button 30 becomes a rigid member upon full compression. In alternative exemplary embodiments, full compression of a compliant plunger button may be defined not by contact between the lower and upper components, but instead by full compression of the compliance spring. In such an embodiment, a slight gap may remain between the upper and lower compliant plunger button components even at full compliant plunger button compression.

Figure 6A:
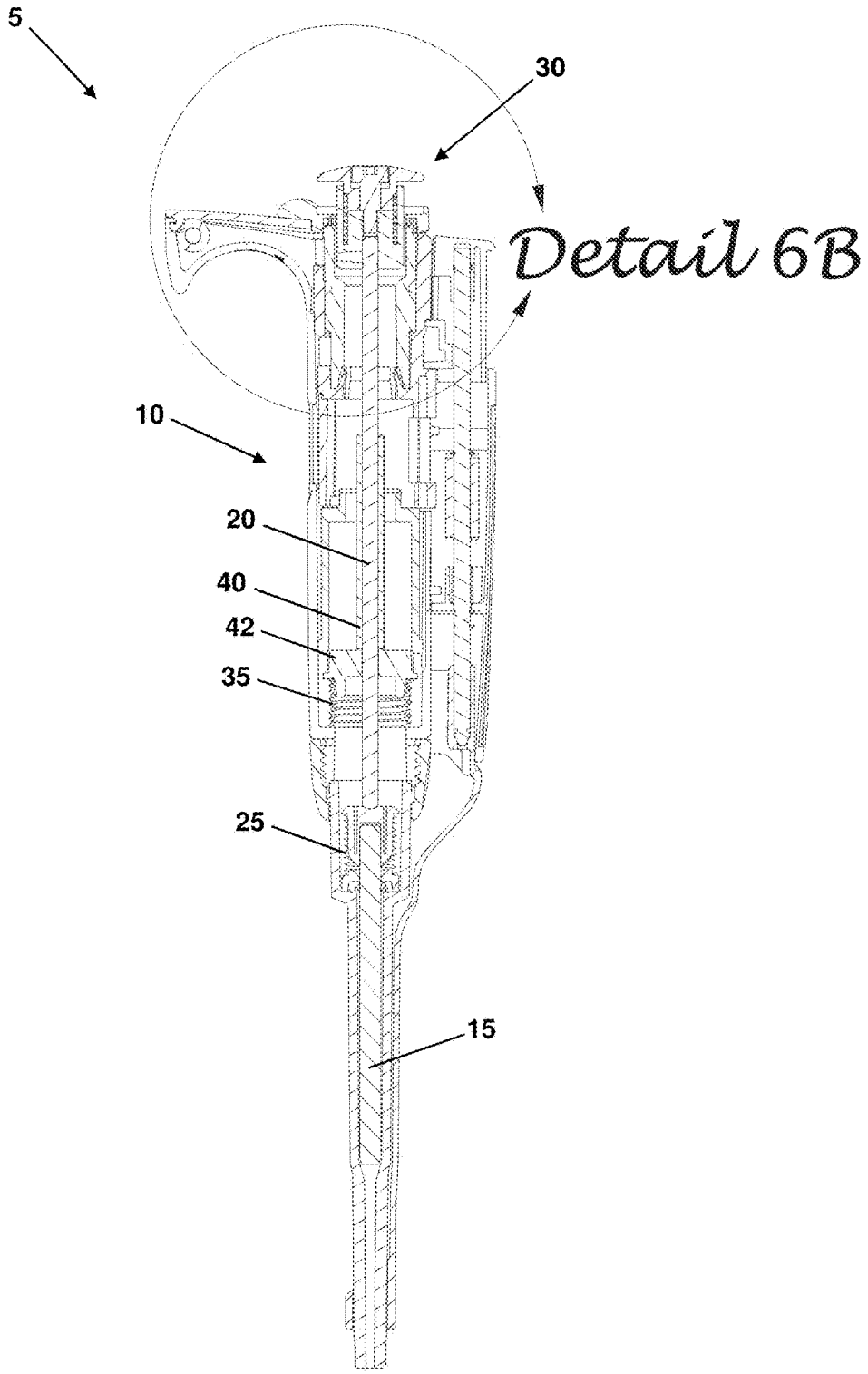
FIG. 6A shows the exemplary pipette of FIG. 2A, with the compliant plunger button thereof fully compressed and with the plunger unit in the blowout position.
Figure 6B:
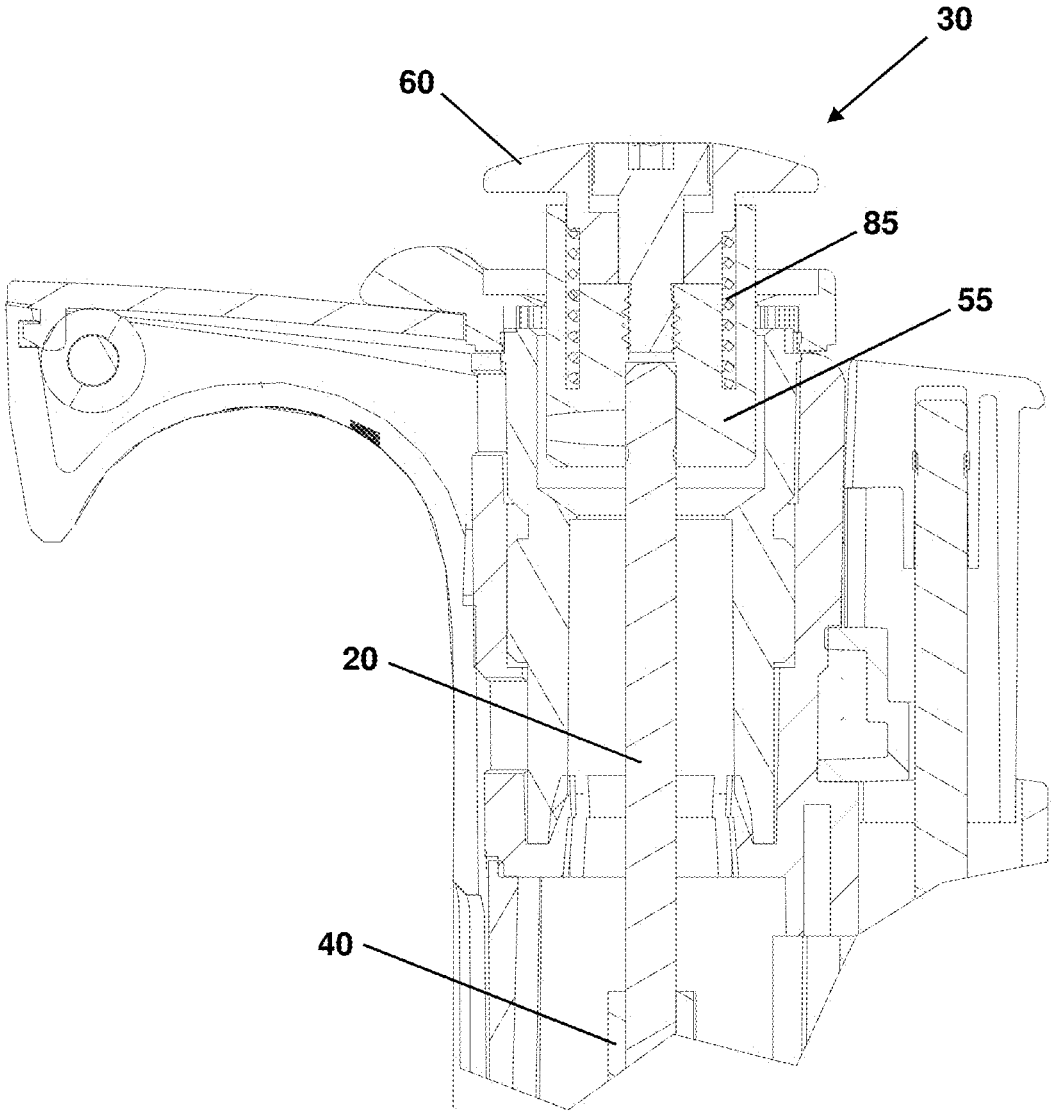
FIG. 6B is an enlarged detail view of the compliant plunger button of FIG. 6A.

FIGS. 6A-6B illustrate movement of the various pipette components during a blowout stroke. The blowout stroke begins with the compliant plunger button 30, the piston 15, the plunger rod 20, the stroke spring 25 and the blowout spring 35 in the positions and states shown in FIGS. 5A-5B. During the blowout stroke, an additional actuating force is applied by a user to the compliant plunger button 30. Because the compliant plunger button 30 is already fully compressed, the additional actuating force is transferred directly to the components of the plunger unit and to the stroke spring 25 and blowout the spring 35. Thus, the piston 15 and the plunger rod 20 (and its associated flange-engaging feature) move further distally relative to the pipette body 10. Application of a sufficient additional actuating force more fully compresses the stroke spring 25 and the blowout spring 35, and causes all remaining liquid in the pipette tip to be expelled. The distally shifted end-of-blowout stroke position of the compliant plunger button 30 may be clearly observed in the detailed view of FIG. 6B.

Figure 7A:
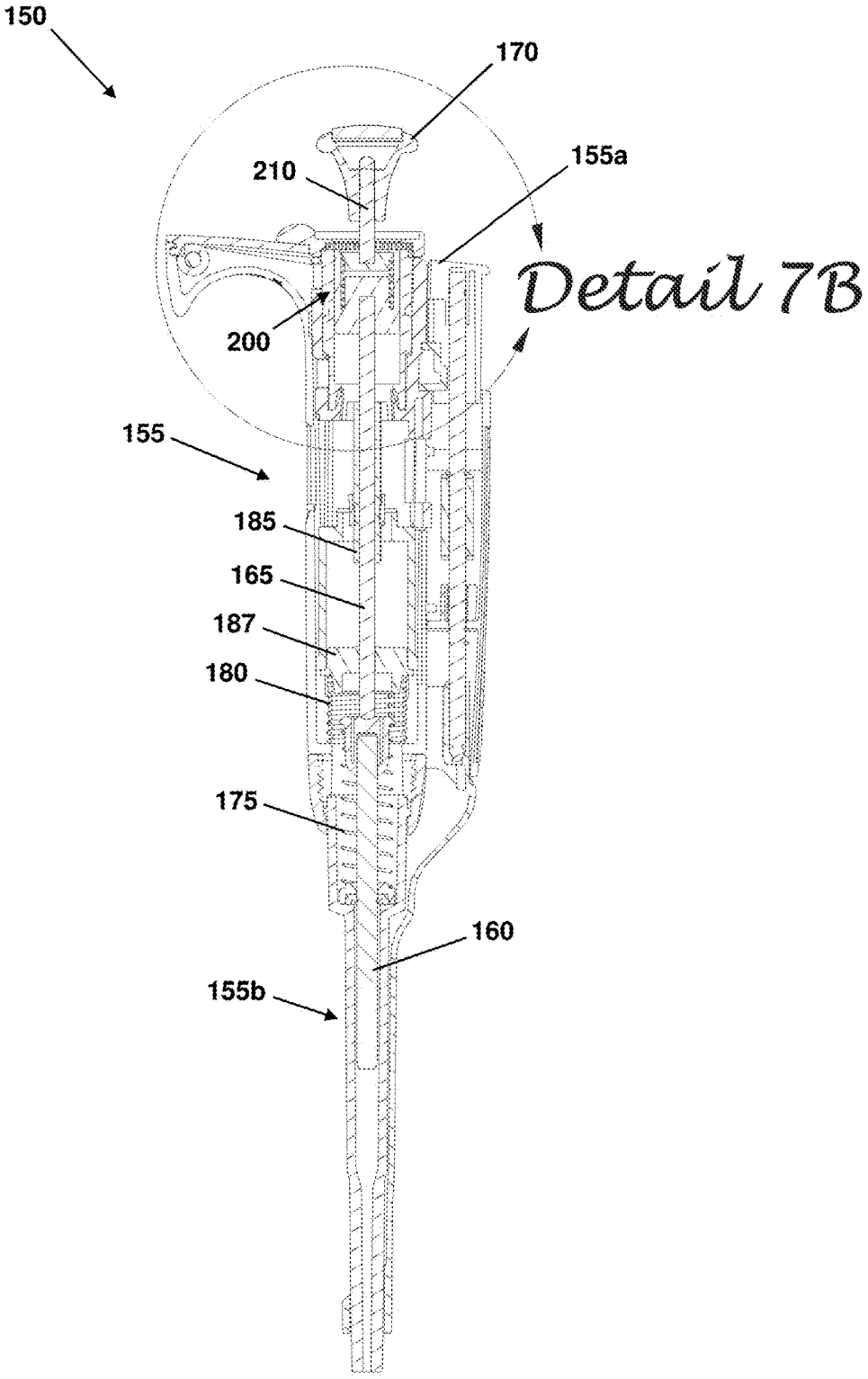
FIG. 7A illustrates an exemplary pipette equipped with an alternative embodiment of a home position locating mechanism that is installed into the pipette body, and with a plunger unit thereof in an upper stop position.

FIG. 7A illustrates an exemplary embodiment of a pipette 150 equipped with an alternative embodiment of a home position locating mechanism. The pipette 150 is similar in many respects to the pipette 5 shown in FIG. 2A. Particularly, the pipette 150 of FIG. 7A also includes a pipette body 155 with a distal tip mounting portion 155*b*, a plunger unit including a piston 160 and a plunger rod 165, and a plunger button 170 that is affixed to a proximal end of the plunger rod. In the position shown in FIG. 7A, the plunger button 170 once again extends from a proximal end 155*a* of the pipette body 155. A stroke spring 175 and a blowout spring 180 are also located within the pipette 150. The plunger rod 165 again includes a flange-engaging feature 185 that interacts with a flange 187 associated with the blowout spring 180 to form a soft stop and to compress the blowout spring during a blowout stroke of the pipette. Generally speaking, user displacement of the piston 160 by way of the plunger button 170 and associated plunger rod 165, and a cooperating reverse displacement of the piston by the stroke spring 175, is used to aspirate and dispense a liquid of interest as described in more detail above with respect to the pipette 5 of FIG. 2A. In this embodiment, however, the home position locating mechanism 200 is installed in the proximal end 155*a* of the pipette body 155 rather than in the plunger button 170.

Figure 7B:
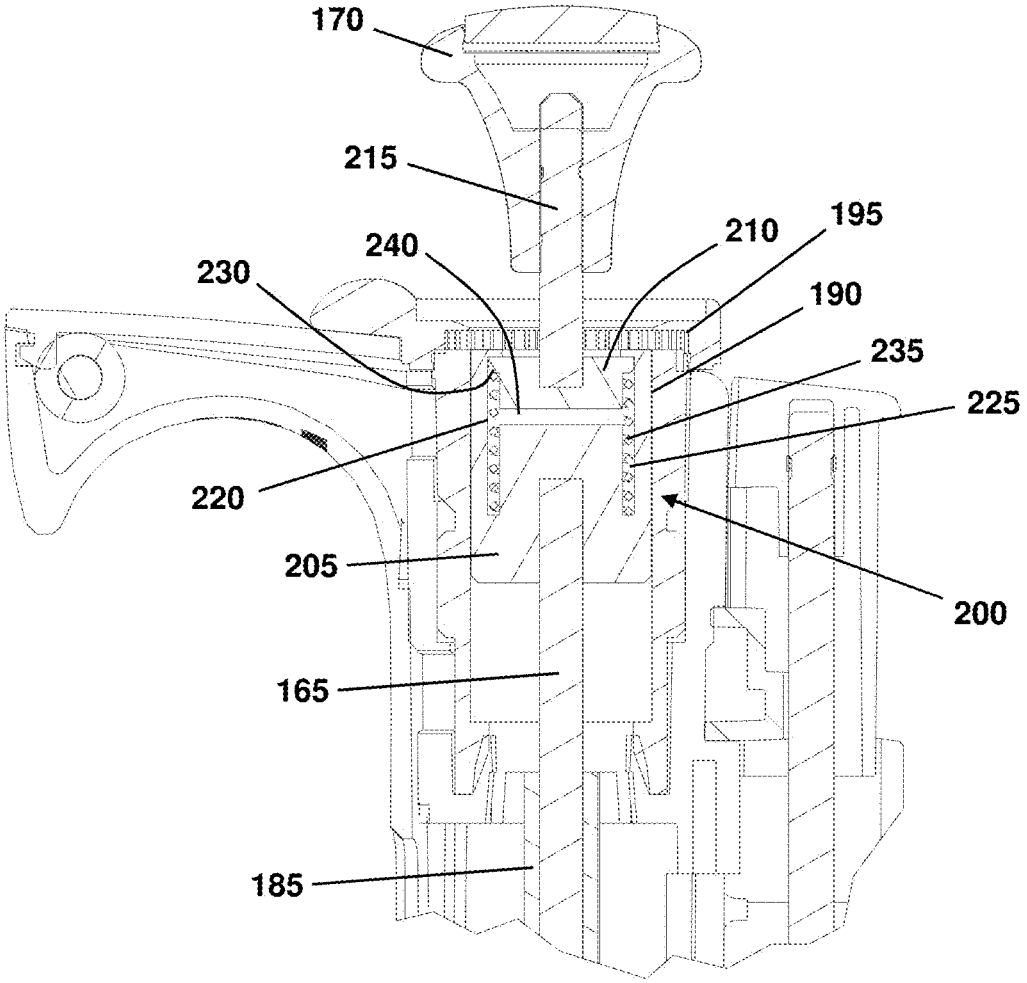
FIG. 7B is an enlarged detail view of the home position locating mechanism of FIG. 7A.

An enlarged detailed view of the home position locating mechanism 200 is presented in FIG. 7B. As shown, this exemplary home position locating mechanism 200 is comprised of a lower component 205 in which is slidably seated an upper component 210. Both the lower component 205 and the upper component 210 are installed into a provided cavity 190 in the proximal end 155*a* of the pipette body 155.

The proximal end of the upper component 210 is adapted for connection to the plunger button 170. In this embodiment, the proximal end of the upper component 210 receives the distal end of a connecting rod 215. A proximal end of the connecting rod 215 is received in the plunger button 170 and is affixed thereto, such as with a set screw, adhesive, a press fit to a shoulder, etc. The connecting rod 215 is provided to transfer user movement of the plunger button 170 to the upper component 210 of the home position locating mechanism 200. The plunger button 170 will normally be engaged and depressed by the thumb of a user during a pipetting operation.

The lower component 205 of this exemplary home position locating mechanism 200 includes a counterbore 220 in its proximal end that is shaped and dimensioned to receive the upper component 210 in a slip fit arrangement. A concentrically located compliance spring retention groove 225 also resides in the lower portion 205 of the home position locating mechanism 200. The upper component 205 of the home position locating mechanism includes a compliance spring retention shoulder 230 that cooperates with the compliance spring retention groove 225 in the lower component 205 to retain a compliance spring 235 within the assembled home position locating mechanism 200.

When the home position locating mechanism 200 is assembled, a distal portion of the compliance spring 235 is located in the compliance spring retention groove 225 of the lower component 205 and extends upward therefrom and beyond the base of the counterbore 220. The upper component 210 is inserted in a slip fit arrangement into the counterbore 220, where the spring retention shoulder 230 thereof engages a proximal end of the compliance spring 235. The upper component 210 may be retained in the counterbore 220 of the lower component 205 in a number of ways, such as without limitation, by a retention feature associated with the proximal end of the lower component or by a feature of the pipette body 155 itself. Thus, although restrained, the upper component 210 is nonetheless axially movable within the counterbore 220. For example, the upper component is movable in a proximal-to-distal direction within the counterbore 220 upon application of a depression force that overcomes the preload force of the compliance spring 235, and in a distal-to-proximal direction under the influence of the compliance spring in the absence of an overcoming depression force.

The assembled home position locating mechanism 200 may be retained in the cavity 190 of the pipette body 155 by a proximal end cap assembly 195 of the pipette or by some other mechanism. When assembled and installed to the pipette body 155, the upper component 210 of the home position locating mechanism 200 resides in a constrained but axially displaceable arrangement within the lower component 205. The compliance spring 235 exerts an upward biasing force on the upper component 210 such that, when the plunger button 170 is not being depressed by a user, a gap 240 is maintained between the distal end of the upper component and the base of the counterbore 220 in the lower component 205. The gap 240 defines the compressive travel range of the home position locating mechanism 200. The compliance spring 235 also offers a tactile resistance to compression of the home position locating mechanism 200 during a pipetting operation, which aids the user in finding and maintaining the home position of the pipette piston 160.

Figure 8A:
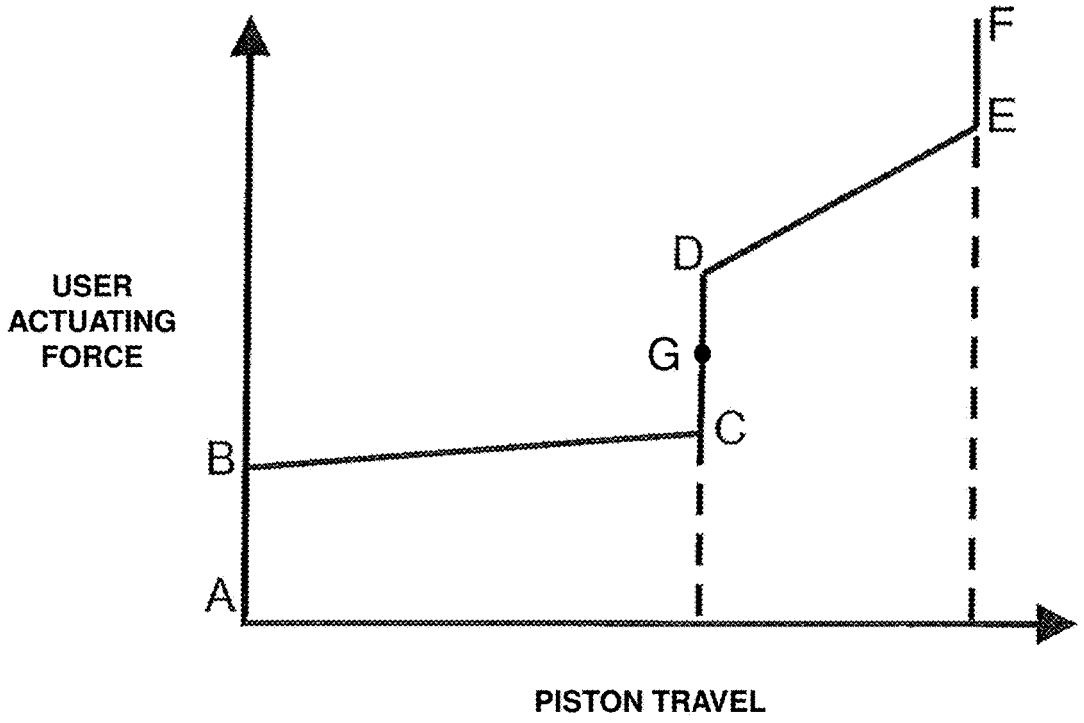
FIG. 8A is a graph showing user actuation force versus plunger unit piston travel for an exemplary home position locating mechanism equipped pipette.

A graphical representation of user actuating force versus piston travel for an exemplary home position locating mechanism equipped pipette, such as the exemplary compliant plunger button equipped pipette 5 of FIGS. 2A-6B, is shown in FIG. 8A. An actuating force applied by a user initially causes the piston of the pipette to move from an upper stop position at point B to the detected home position at point C. Point B of FIG. 8A corresponds to the pipette condition shown in FIGS. 2A-2B, and point C corresponds to the pipette condition shown in FIG. 3. The home position of the piston is represented in the graph of FIG. 8A by the substantially vertical line extending between point C and point D, which also indicates the increased depression force required to further move the plunger unit as the blowout spring is engaged and eventually begins to compress. Point D of FIG. 8A corresponds to the pipette condition shown in FIGS. 5A-5B. The line extending between point D and point E in FIG. 8A represents further movement of the piston from the home position toward a lower stop position during a blowout stroke. Point E of FIG. 8A corresponds to the pipette condition shown in FIGS. 6A-6B.

The graph of FIG. 8A also includes a point G on the line extending between points C and D. In FIG. 8A, point G indicates occurrence of the compliant plunger button 30 compression stroke, which is represented in FIGS. 4A-4B. As indicated, there is no substantial movement of the piston 15 during compression of the compliant plunger button 30.

Figure 8B:
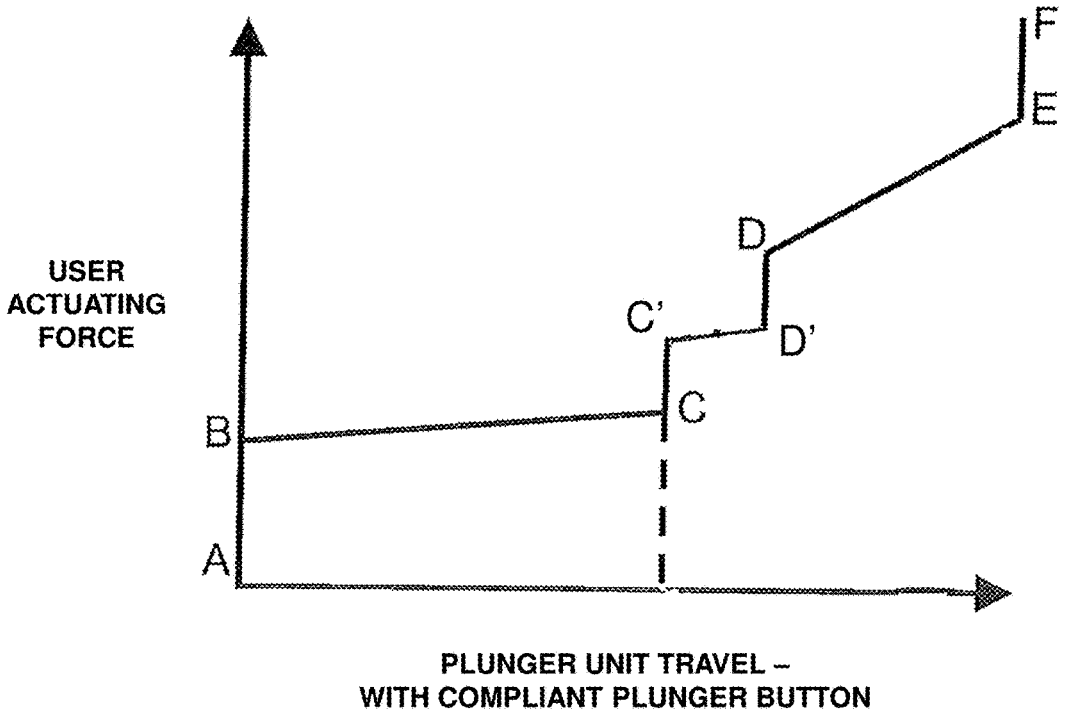
FIG. 8B is a graph showing user actuation force versus overall plunger unit travel for an exemplary home position locating mechanism equipped pipette.

FIG. 8B graphically depicts actuating force versus user thumb movement for an exemplary home position locating mechanism equipped pipette, such as the exemplary compliant plunger button equipped pipette 5 of FIGS. 2A-6B. An actuating force applied by a user again causes the piston of the pipette to move from an upper stop position at point B to the detected home position at point C. Point B of FIG. 8B corresponds to the pipette condition shown in FIGS. 2A-2B, and point C corresponds to the pipette condition shown in FIG. 3. The home position of the plunger unit is again represented in the graph of FIG. 8B by the line extending between point C and point D.

In the graph of FIG. 8B, the compression stroke of the compliant plunger button 30 represented by point G in FIG. 8A, appears as a rightward-angled step C'-D' between point C and point D. The rightward-angled C'-D' step in FIG. 8B represents further movement of the user's thumb as the compliant plunger button 30 is compressed, while the piston 15 remains in the home position. The midpoint along the rightward angled step C'-D' corresponds to the pipette condition represented in FIGS. 4A-4B. Point D of FIG. 8B again corresponds to the pipette condition shown in FIGS. 5A-5B. The line extending between point D and point E in FIG. 8B again represents further movement of the piston from the home position toward a lower stop position during a blowout stroke. Point E of FIG. 8B corresponds to the pipette condition shown in FIGS. 6A-6B.

The exemplary embodiments shown and described herein are provided only for purposes of illustration, and not limitation. It should be realized by one of skill in the art—particularly upon further reading of the application—that other home position locating mechanism designs may also be employed as long as said designs allow for proper movement of the pipette plunger unit and for proper compression of the home position locating mechanism at an appropriate time.

It can be understood from the foregoing description that the use of an exemplary home position locating mechanism eliminates the need for a user to develop a "feel" for a soft stop home position as is traditionally required in the case of known manual pipettes. Instead, the user need only ensure that the home position locating mechanism is somewhere between the beginning and end of its compression stoke to accurately and repeatably return the pipette piston to within a very small positional variation of the same home position during each aspiration stroke. This improves the pipetting results, not only by reducing the deviation in aspirated liquid volume across a number of pipetting operations, but also because the use of a home position locating mechanism can help to ensure that the home position as determined by a user coincides with the home position as set during calibration of the pipette.

Several types of feedback may be used to indicate to a user that the position of an exemplary home position locating mechanism is somewhere within its range of compression. For example, the user may obviously feel and/or see movement of the pipette plunger button. In the case of the exemplary compliant plunger button 30 described above, the length of the shoulder bolt may also be selected such that a portion of the head of the shoulder bolt will protrude from the upper portion 60 of the compliant plunger button and contact the user's thumb to indicate that the compliant plunger button has been sufficiently compressed. An audible or visual alert may also be used as an indicator. For example, a home position locating mechanism may be associated with a powered buzzer, or may include some internal mechanism that will mechanically produce a sound at some point within the home position locating mechanism compression range. Similarly, a home position locating mechanism may be associated with a powered light (e.g., LED), or another visual indicator that would be perceptible to the user during a pipetting operation. Such means of feedback may be used individually or in combination.

An exemplary home position locating mechanism need not be permanently installed to a given pipette. For example, an exemplary home position locating mechanism—such as, but not limited to a compliant plunger button—may be installed to a home position (soft-stop) equipped pipette for training purposes and then removed if/once a user develops the ability to accurately and repeatably find the home position by feel of the soft stop alone.

While exemplary home position locating mechanisms are described herein as including a compliance spring, it is to be understood that home position locating mechanism embodiments are not limited to the use of a particular type of spring, nor to a spring in the traditional sense. For example, when a spring is used, the spring may be a coil spring, a leaf spring, or another type of spring element suitable to the particular home position locating mechanism design. In other exemplary home position locating mechanism embodiments, a lever or another bendable element may be used to provide a biasing force in lieu of a traditional spring. All of such elements are considered to be springs for purposes of this application.

As used herein, the term "distal" is intended to refer to the end of the pipette where the pipette tip normally resides, and the term "proximal" is intended to refer to the end of the pipette where the plunger button normally resides.

As used herein, the terms "axial" or "axially" are intended to refer to a direction that is parallel to the length-wise axis of the plunger rod when installed to the pipette body.

As used herein, the term "central aperture" is intended to refer to an opening centered around the symmetrical axis of a component or the pipette.

As used herein, the term "downward" is intended to refer to a proximal-to-distal direction relative to the pipette body, and the term "upward" is intended to refer to a distal-to-proximal direction relative to the pipette body.

As used herein, the term "lower" is intended to refer to a component position that is closer to the distal end of the pipette than another component, and the term "upper" is intended to refer to a component position that is closer to the proximal end of the pipette than another component.

While certain exemplary embodiments of a home position locating mechanism and a pipette equipped with the same are described in detail above, the scope of the inventive concept is not considered limited by such disclosure, and modifications are possible as evidenced by the following claims:

What is claimed is:

1. A pipette home position locating mechanism for installation to a pipette having a stroke spring and a soft stop home position indicated by a blowout spring, the mechanism comprising:

a lower component having a distal end adapted for attachment to a plunger rod of the pipette;

an upper component forming a user-engageable plunger button portion and coupled to the lower component in an axially displaceable manner; and a preloaded compliance spring located between the lower component and the upper component such that the upper component is normally biased away from the lower component with a gap between said components;

wherein a preload force exerted by the compliance spring is selected to be greater than the force exerted by the stroke spring at its blowout position, but less than the combined force exerted by the stroke spring at its blowout position and the blowout spring in its preload position.

2. The pipette home position locating mechanism of claim 1, wherein a distal end of the upper component is slidably located within a counterbore in a proximal end of the lower component.

3. The pipette home position locating mechanism of claim 2, wherein the compliance spring is trapped between a retention shoulder on the upper component and a retention grove in the lower component.

4. The pipette home position locating mechanism of claim 2, wherein the upper component is coupled to the lower component by a shoulder bolt upon which the upper component is axially slidable.

5. The pipette home position locating mechanism of claim 1, wherein the gap between the upper and lower components defines a compression range of movement of the home position locating mechanism.

6. The pipette home position locating mechanism of claim 1, wherein the relationship of the preload force exerted by the compliance spring to the forces exerted by the stroke spring and the blowout spring of the pipette is such that:

upon application of a depression force on the upper component, the plunger rod of the pipette will be axially displaced until the soft stop home position of the pipette is reached;

whereafter, application of a greater depression force on the upper component will overcome the preload force of the compliance spring and cause the upper component of the home position locating mechanism to begin moving axially toward the lower component.

7. The pipette home position locating mechanism of claim 6, wherein upon full depression of the upper component toward the lower component, the locating mechanism will effectively act as a rigid member, such that exertion of a further depression force on the upper component will result in compression of the blowout spring of the pipette.

8. The pipette home position locating mechanism of claim 1, wherein axial displacement of the upper component toward the lower component will occur within a linear range of a home position force curve of the pipette.

9. The pipette home position locating mechanism of claim 1, further comprising a noise generator that is adapted to produce an audible sound during movement of the upper component toward the lower component.

10. A pipette home position locating mechanism for installation in the body of a pipette having a stroke spring and a soft stop home position indicated by a blowout spring, the mechanism comprising:

a lower component adapted for installation into a cavity in the body of the pipette, and having a distal end adapted for communication with a plunger rod of the pipette;

an upper component retained in an axially displaceable arrangement within a counterbore in the proximal end of the lower component, the upper component having a proximal end adapted for connection to a plunger button of the pipette; and a preloaded compliance spring located between the lower component and the upper component such that the upper component is normally biased away from the lower component with a gap between said components;

wherein a preload force exerted by the compliance spring is selected to be greater than the force exerted by the stroke spring at its blowout position, but less than the combined force exerted by the stroke spring at its blowout position and the blowout spring in its preload position.

11. The pipette home position locating mechanism of claim 10, wherein the compliance spring is trapped between a retention shoulder on the upper component and a retention grove in the lower component.

12. The pipette home position locating mechanism of claim 10, wherein the gap between the upper and lower components defines a compression range of movement of the home position locating mechanism.

13. The pipette home position locating mechanism of claim 10, wherein the relationship of the preload force exerted by the compliance spring to the forces exerted by the stroke spring and the blowout spring of the pipette is such that:

upon application of a depression force on the upper component, the plunger rod of the pipette will be axially displaced until the soft stop home position of the pipette is reached;

whereafter, application of a greater depression force on the upper component will overcome the preload force of the compliance spring and cause the upper component of the home position locating mechanism to begin moving axially toward the lower component.

14. The pipette home position locating mechanism of claim 13, wherein upon full depression of the upper component toward the lower component, the locating mechanism will effectively act as a rigid member, such that exertion of a further depression force on the upper component will result in compression of the blowout spring of the pipette.

15. The pipette home position locating mechanism of claim 10, wherein axial displacement of the upper component toward the lower component will occur within a linear range of a home position force curve of the pipette.

16. The pipette home position locating mechanism of claim 10, further comprising a noise generator that is adapted to produce an audible sound during movement of the upper component toward the lower component.

17. A manually-operated pipette, comprising:

a pipette body having a proximal end and a distal end;

a plunger assembly, the plunger assembly including a piston located for reciprocating movement within the pipette body and a plunger rod that extends proximally upward from the piston;

a preloaded stroke spring that resides within the pipette body;

a preloaded blowout spring that resides within the pipette body, the blowout spring acting as a soft stop indicator of pipette home position; and a home position locating mechanism, the home position locating mechanism comprising:

a lower component, an upper component coupled to the lower component in an axially displaceable manner; and a preloaded compliance spring located between the lower component and the upper component such that the upper component is normally biased away from the lower component with a gap between said components;

wherein, a preload force exerted by the compliance spring of the home position locating mechanism is greater than the force exerted by the stroke spring of the pipette at its blowout position, but less than the combined force exerted by the stroke spring at its blowout position and the blowout spring in its preload position.

18. The pipette of claim 17, wherein:

the proximal end of the plunger rod protrudes through the proximal end of the pipette body; and the home position locating mechanism is in the form of a compliant plunger button attached to the proximal end of the plunger rod, the lower component having a distal end that is adapted for attachment to the proximal end of the plunger rod, and the upper component forming a user-engageable portion of the compliant plunger button.

19. The pipette of claim 17, wherein:

the proximal end of the plunger rod resides within the pipette body;

the lower component of the home position locating mechanism is adapted for installation into a cavity in the pipette body, and has a distal end that is adapted for communication with the proximal end of the plunger rod; and the upper component is retained in an axially displaceable arrangement within a counterbore in the proximal end of the lower component, and has a proximal end that is adapted for connection to a plunger button of the pipette.

20. The pipette of claim 17, wherein the relationship of the preload force exerted by the compliance spring off the home position locating mechanism to the forces respectively exerted by the stroke spring and the blowout spring of the pipette is such that:

upon application of a depression force on the upper component of the home position locating mechanism, the plunger rod of the pipette will be axially displaced until the soft stop home position of the pipette is reached;

whereafter, application of a greater depression force on the upper component of the home position locating mechanism will overcome the preload force of the compliance spring and cause the upper component of the home position locating mechanism to begin moving axially toward the lower component.

21. The pipette of claim 20, wherein upon full depression of the upper component of the home position locating mechanism toward the lower component, the locating mechanism will effectively act as a rigid member, such that a further depression force applied to the upper component will be transferred to the blowout spring of the pipette as a compression force.

22. The pipette of claim 17, wherein axial displacement of the upper component of the home position locating mechanism toward the lower component of the home position locating mechanism will occur within a linear range of a home position force curve of the pipette.

23. The pipette of claim 17, further comprising a noise generator that is adapted to produce an audible sound during compression of the home position locating mechanism.

* * * * *